US005115966A

United States Patent [19]

McKibben et al.

[11] Patent Number: 5,115,966

[45] Date of Patent: May 26, 1992

[54] PACKAGE HAVING A FORMED FITTING EXTERNAL PLUG FIT MEASURING CAP

[75] Inventors: Gary E. McKibben, Middletown, Ohio; Vernon N. Goetz, Villa Hills, Ky.; Elise M. Boehm, Cincinnati, Ohio

[73] Assignee: The Procter & Gamble Company, Cincinnati, Ohio

[21] Appl. No.: 802,383

[22] Filed: Dec. 4, 1991

[51] Int. Cl.[5] ..... B65D 39/04; B65D 5/44

[52] U.S. Cl. ..... 229/125.03; 206/229; 222/158; 229/125.17

[58] Field of Search ..... 206/229; 229/125.03, 229/125.17; 222/158, 192, 562, 563

[56] References Cited

U.S. PATENT DOCUMENTS

| | | | |
|---|---|---|---|
| Re. 21,310 | 12/1939 | Mackey | 221/11 |
| 550,441 | 11/1895 | Danz . | |
| 1,240,563 | 9/1917 | Griffith et al. . | |
| 1,308,883 | 7/1919 | Weis | 229/125.17 |
| 1,346,558 | 7/1920 | Rosenwasser . | |
| 1,767,742 | 6/1930 | Case . | |
| 2,201,332 | 5/1940 | Bensel | 229/125.17 |
| 2,282,150 | 5/1942 | Andary | 229/7 |
| 2,770,403 | 11/1956 | Eckley | 222/424.5 |
| 2,781,156 | 2/1957 | Wallo | 222/531 |
| 2,805,812 | 9/1957 | Seaton | 229/43 |
| 2,811,281 | 10/1957 | Donovan | 206/229 |
| 2,820,491 | 1/1958 | Kromsten | 222/158 |
| 3,094,244 | 6/1963 | White | 206/229 |
| 3,146,914 | 9/1964 | Eckley | 222/158 |
| 3,180,552 | 4/1965 | Atkinson, Jr. | 229/7 |
| 3,215,329 | 11/1965 | Pugh, Sr. | 229/7 |
| 3,265,282 | 8/1966 | Maxwell | 229/7 |
| 3,269,635 | 8/1966 | Bergstein et al. | 229/14 |
| 3,615,039 | 10/1971 | Ward | 220/97 C |
| 3,695,504 | 10/1972 | Simpson | 229/7 |
| 3,733,022 | 5/1973 | Kapiloff | 229/7 R |
| 3,981,432 | 9/1976 | Bergstein et al. | 229/125.17 |
| 4,249,693 | 2/1981 | Diaz | 206/229 |
| 4,421,236 | 12/1983 | Lowe | 206/621 |
| 4,693,414 | 9/1987 | Allen | 229/125.02 |
| 4,852,764 | 8/1989 | Stone | 220/315 |

FOREIGN PATENT DOCUMENTS

| | | | |
|---|---|---|---|
| 1115971 | 5/1956 | France | 229/125.17 |

*Primary Examiner*—Gary E. Elkins

*Attorney, Agent, or Firm*—E. Kelly Linman; Thomas H. O'Flaherty; Richard C. Witte

[57] ABSTRACT

A package for storing and dispensing granular materials such as dishwashing detergent. The package has a carton section, preferably made from paperboard, that has a plug receptacle preferably in its top wall adjacent the top edge. The package further includes a corner cap for measuring quantities of the granular material. The corner cap form fits over the corner of the package that has the plug receptacle adjacent to it. The cap has a plug extending into its inner container space so as to telescope into the plug receptacle in a complimentary fashion when the cap is placed on the carton. The plug and plug receptacle ensure that the cap remains securely attached to the carton when not in use. The carton also includes a dispensing orifice for dispensing the granular material from the carton into the cap. The plug receptacle can be the dispensing orifice if it extends through the entire distance of the top wall. The dispensing orifice may also be a separate feature located on the side wall of the carton adjacent the same top edge that the plug receptacle is adjacent to and may further include a pouring spout.

11 Claims, 8 Drawing Sheets

PACKAGE HAVING A FORMED FITTING EXTERNAL PLUG FIT MEASURING CAP

FILED OF THE INVENTION

The present invention relates to dispensing containers for particulate granular material.

BACKGROUND OF THE INVENTION

Granular materials such as dishwashing detergents are typically packaged in rectangular paperboard packages. The packages are generally provided with a dispensing orifice on the side of the container immediately below the top of the package. Currently, measuring cups and similar devices are not needed for dishwashing detergents. To ensure that the correct amount of detergent will be used the dishwashers themselves have receptacles that show consumers where to pour the product and how much to use. Such receptacles usually take the form of a cup type device attached to the door of the machine. The consumer pours the product into the cup-type device until the product reaches the top or a marked fill line.

Recently, due to advances in soap technology, products such as dishwashing detergents have become more concentrated, thereby allowing the use of a smaller volume of product than used before. Because the soap is more concentrated the receptacles on existing dishwashers used to measure the correct amount of detergent are too large. Therefore, filling the receptacle as usual results in too much soap being placed in the dishwasher which is wasteful. It therefore became apparent that measuring devices are now needed in order to place the proper amount of soap in a dishwashing machine. It is preferable that the measuring device be integral with or attached to the detergent package. This ensures that the measuring device is always readily available when the product is used.

Examples of packages having measuring cups integral therewith can be found in U.S. Pat. No. 2,820,491 issued to Crompston on Jan. 21, 1958 and U.S. Pat. No. 4,249,693 issued to Diaz on Feb. 10, 1981. Both of these patents describe what can be referred to as a corner cap measuring device. That is the package comprises a carton and a measuring device in the shape of a prism and having dimensions conforming to a corner of the package. The corner cap then easily form fits over a corner of the carton for storage. The corner cap is usually marked with a fill line to show how much product the user is to pour into the corner cap.

A problem associated with these corner caps has been to provide a practical means for securing the corner cap onto the carton so that it will not fall off during shipping and handling. One method used in the past is to have the side walls of the corner cap inwardly biased so that they grip the sides of the package. However, this means that the side walls must then somehow be moved outwardly to place the cap onto the carton during assembly. Because the corner cap does not easily fit over the corner of the carton, this method of securing the cap to the carton slows down the assembly of the package and is not suited for mass manufacturing.

Another method used in the past to secure the corner cap to the carton has been to tape the corner cap onto the package. The tape is removed and discarded by the consumer prior to its first use. However, when using this method the consumer has no way to re-secure the corner cap to the carton after first using the product.

This allows the cap to detach itself easily from the package and become lost.

It is therefore an object of the present invention to provide a package for granular materials having a corner cap wherein the corner cap is securely retained to the carton prior to first use.

It is another object of the present invention to provide such a package wherein the corner cap can easily be re-secured to the carton after first use.

It is another object of the present invention to provide such package that can be assembled quickly and is inexpensive to manufacture.

The aforementioned and other objects of the invention will become more apparent hereinafter.

SUMMARY OF THE INVENTION

In accordance with the present invention there is provided a package for storing and dispensing granular materials. The package comprises a generally rectangular carton having opposing front and back walls, opposing side walls and opposing top and bottom walls. The carton includes a plug receptacle formed in either its top wall or a side wall at a location adjacent a top edge of the carton which extends between the front and rear walls. The package further includes a removable corner cap for measuring a predetermined quantity of material. The corner cap includes two primary walls having substantially the same width as the top edge of the carton and joined together along a common edge at a substantially right angle. Two opposing secondary walls are connected to the primary walls along their side edges such that the cap forms a cup type container having an inner container space. One of the primary side walls has a plug extending into the container space. The plug is so located, sized and shaped that it will telescope into the plug receptacle when the cap is applied to the carton with the common edge of the cap overlying the top edge of the carton.

BRIEF DESCRIPTION OF THE DRAWINGS

While the specification concludes with claims particularly pointing out and claiming the subject invention, it is believed that the same will be better understood from the following description taken in conjunction with the accompanying drawings in which:

DETAILED DESCRIPTION OF THE INVENTION

Figure 1:
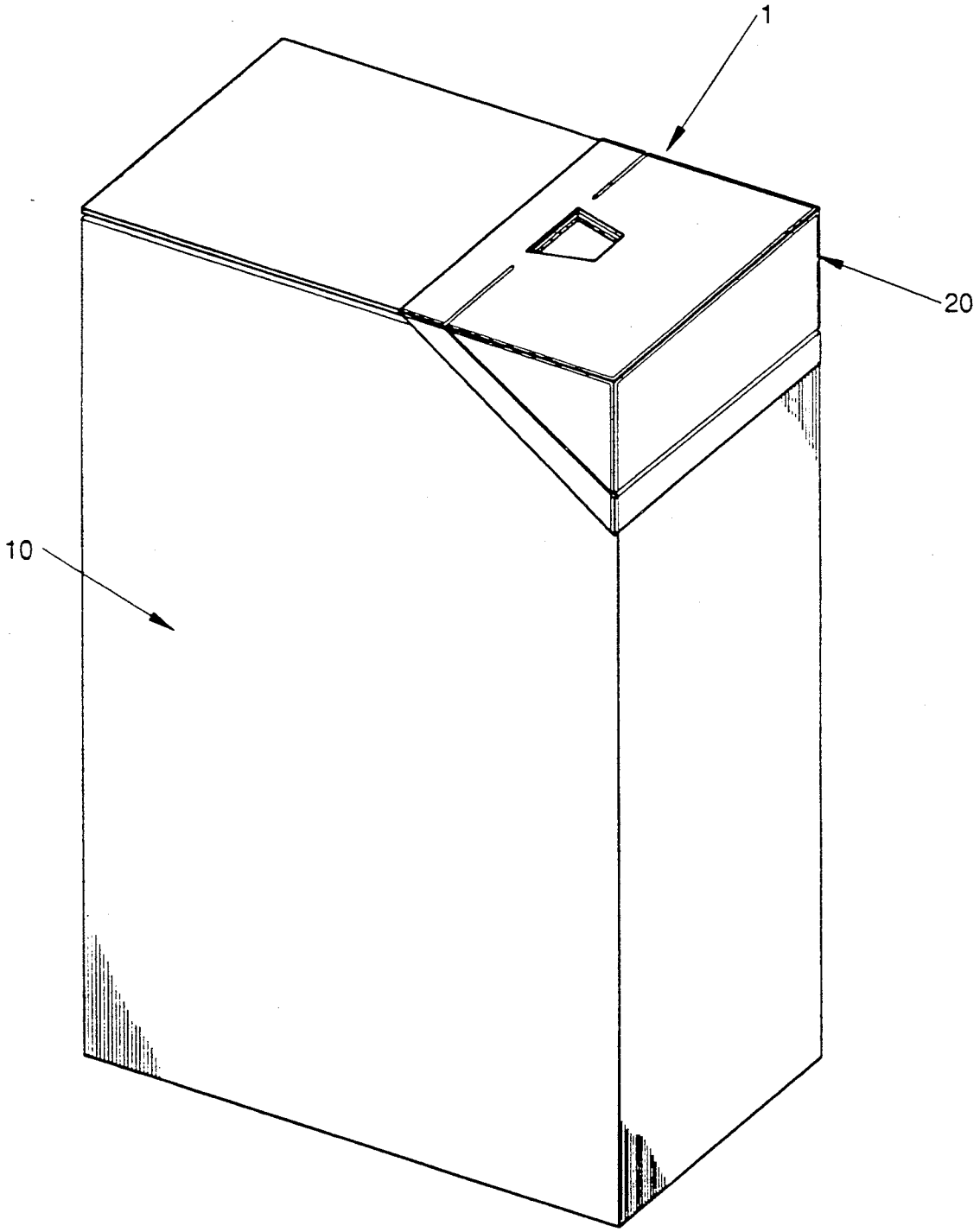
FIG. 1 is a perspective view of the package of the present invention.

Referring now to the drawings wherein like numerals indicate the same element throughout the views there is shown in FIG. 1 a generally rectangular package 1 for granular or particulate products. Package 1 comprises a carton 10 and removable corner cap 20. This can best be seen from FIG. 2 where cap 20 is removed from carton 10.

Carton 10 comprises front wall 11, back wall 12, side walls 13 and 14, top wall 15, and bottom wall 16. Carton 10 further includes plug receptacle 17 adjacent top edge 18 which extends from front wall 11 to back wall 12. Corner cap 20 comprises primary walls 21 and 22 joined at a substantially right angle along common edge 25, and opposing secondary walls 23 and 24. Secondary wall 23 is joined to primary walls 21 and 22 along the length of their side edges 26 and 27. Similarly, secondary wall 24 is joined to primary walls 21 and 22 along the length of their side walls 28 and 29. The connection of walls 21, 22, 23 and 24 forms a cup type container having an inner container space 34 and a fill line 35. Corner cap 20 further includes a plug or protrusion 30 extending into the container space 34.

When the cap 20 is placed on the carton 10, as shown in FIG. 1, common edge 25 overlays top edge 18. Plug 30 is so located sized and shaped that it telescopes into plug receptacle 17 so as to secure the cap 20 to the carton 10. To more easily place the cap 20 onto the carton 10 secondary walls 23 and 24 can be bowed outwardly so that they do not catch on the edges of the carton 10. This also makes it easier for any automated machinery to assemble the package.

Figure 3:
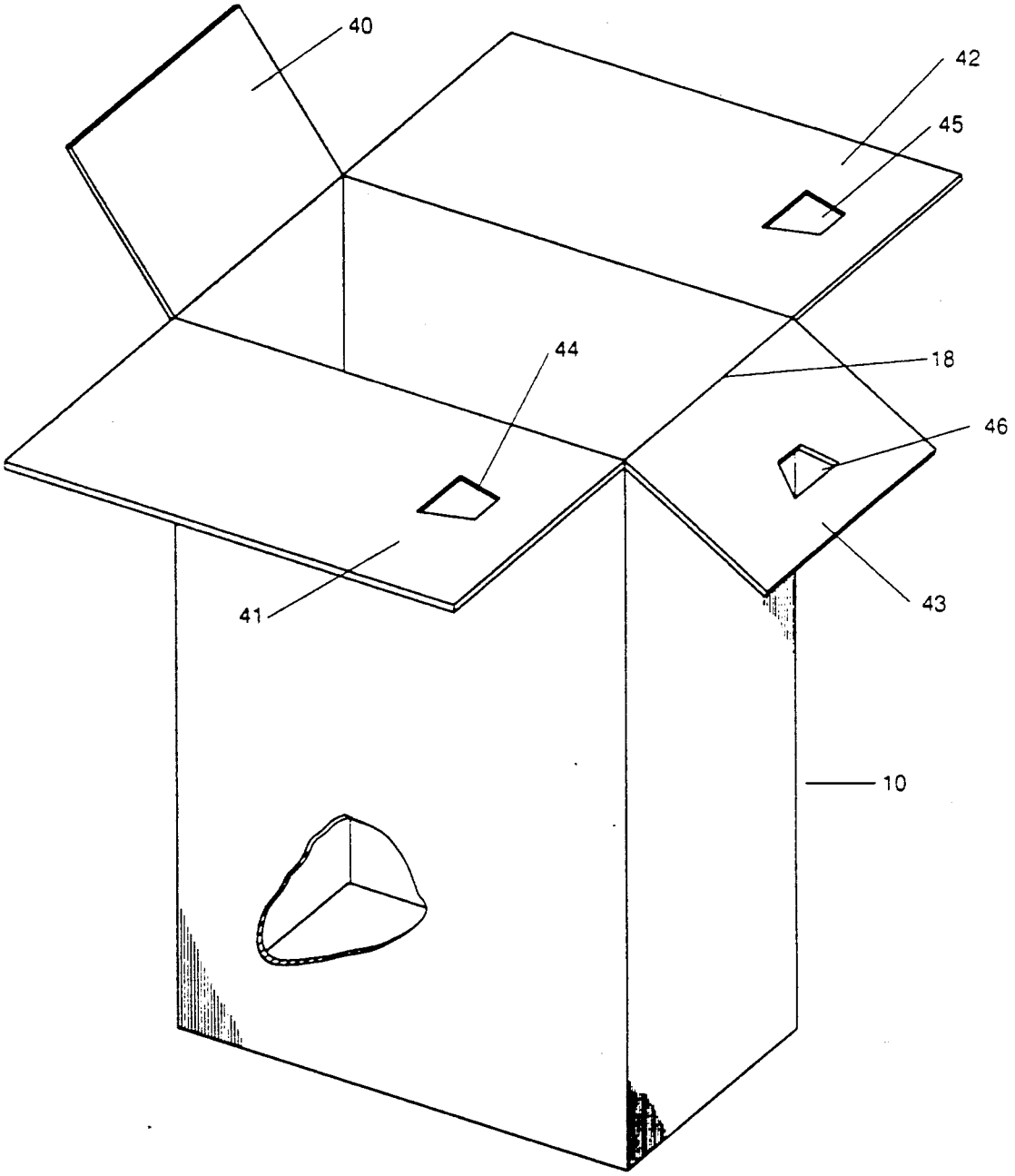
FIG. 3 is a perspective view of a carton of the present invention wherein the top wall is disassembled.

Carton 10 is preferably made from a single blank of paperboard material. FIG. 3 shows the carton in its assembled condition except for top wall 15. As seen from this figure the top wall 15 typically comprises major panels 41 and 42, and minor panels 43 and 40. To construct top wall 15 a major panel, such as panel 41, is folded over to become generally parallel with bottom wall 16. Glue or some other adhesive is applied to the top of panel 41. The two minor panels 43 and 40 are folded so as to be overlapping and secured to major panel 41. Glue or some other adhesive is then applied to the tops of the minor panels 43 and 40. Thereafter major panel 42 is folded so as to be overlapping and secured to minor panels 43 and 40. Furthermore, any portion of major panel 41 that is not covered by minor panels 40 and 43 can be secured to major panel 42. It has been found that folding a major panel first then the two minor panels and then the other major panel provides the best seal on top wall 15 so as to prevent granular material from migrating around the panels and leaking through the top of the carton.

The plug receptacle 17 is created by providing an aperture in the top wall that has substantially the same size and shape as the cross-section of the plug 30. This is accomplished by providing aperture 45 in major panel 42 and aperture 46 in minor panel 43. Aperture 45 should have substantially the same dimensions as the cross-section of the plug in order to give a snug fit. The dimensions of aperture 46 should be at least as big as the cross-section of plug 30 so as to allow the plug to extend there through.

In order to dispense the product from the carton into the cap it is necessary that the carton have a dispensing orifice. This dispensing orifice can be the same feature as the plug receptacle or they can be separate features. In order for the plug receptacle 17 to also act as the dispensing orifice it is necessary that the plug receptacle 17 penetrate completely through the top wall 15. This is accomplished by providing major panel 41 with aperture 44. By making the aperture 44 at least as big as the cross-section of plug 30, plug 30 is able to telescope further into the carton 10 so as to better secure the cap 20 to the carton 10 and creates a better seal. In general aperture 44 is substantially equal in size to aperture 46.

Referring back now to FIG. 2, if the plug receptacle 17 is to also act as the dispensing orifice it is preferable that plug receptacle 17 be as close to top edge 18 as possible. This is to prevent the granular product from being trapped inside the carton between the bottom edge 70 of plug orifice 17 and top edge 18 of carton 10 during pouring. How close the plug receptacle 17 can be to top edge 18 is often limited by the amount of surface area needed between bottom edge 70 of plug receptacle 17 and top edge 18 to effectively glue minor panel 43 to top panel 42, shown in FIG. 3. Furthermore, it has also been found that the trapezoidal shape of plug receptacle 17 having bases 70 and 71 substantially parallel to top edge 18, or the fact that the top edge 71 is larger than the bottom edge 70, gives good control over the pouring of the product into cap 20.

Figure 4:
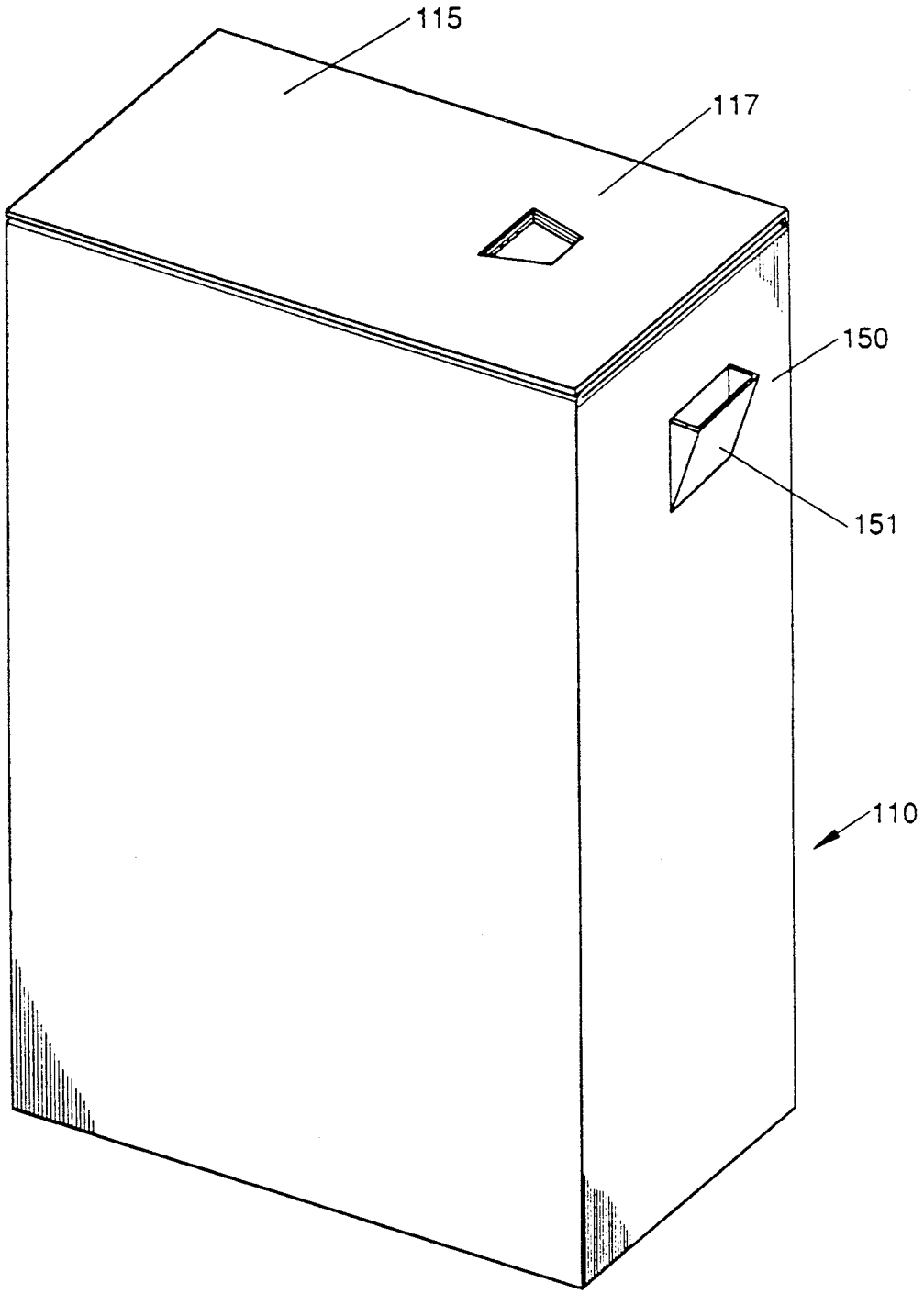
FIG. 4 is a perspective view of an embodiment of a carton of the present invention.

If the dispensing orifice is to be separate from the plug receptacle side panel 43 should not be provided with aperture 46. Otherwise, product would escape through the top wall 15 of the carton if the carton is dropped or otherwise mishandled. An example of a package having a dispensing orifice separate from the plug receptacle is shown in FIG. 4. FIG. 4 is a perspective view of an alternative embodiment of a carton of the present invention. Carton 110 has top wall 115 having a plug receptacle 117 adjacent top edge 118. Carton 110 has a dispensing orifice 150 and pouring spout 151. Pouring spout 151 has an open position for dispensing the product and a closed position to seal orifice 150. Aluminum pouring spouts similar to the one shown in FIG. 4 are commonly found on most commercial dishwashing detergent packages.

Figure 2:
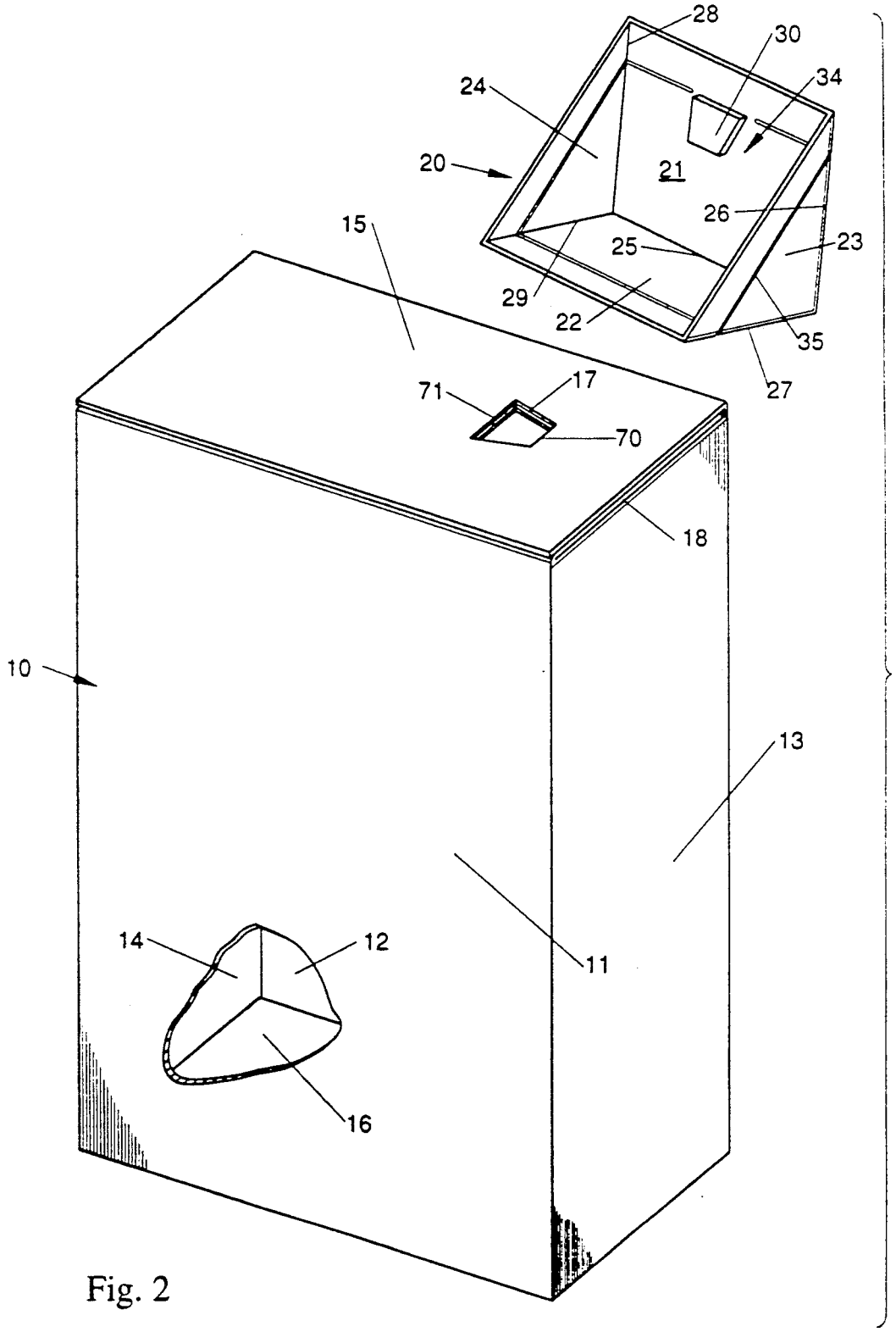
FIG. 2 is an exploded view of the package of the present invention wherein the cap 20 is removed from the carton 10 wherein the cap is tilted at an angle so as to display its interior chamber 34.

Corner cap 20, shown in FIG. 2, is preferably made from polyethylene terephthalate and is manufactured and shaped using thermoforming. Other methods of manufacture can be quite suitable such as injection molding and other materials for the cap, such as paperboard may prove to be useful. In one embodiment the fill line comprises an indented line extending around the perimeter of the cap along line 35 of FIG. 2. The plug preferably comprises a hollow indented section extending into container space 34. The cross sectional shape of the plug should generally be the same as that of plug receptacle 17 so that the plug telescopes into the the plug receptacle in a complimentary fashion.

Figure 5:
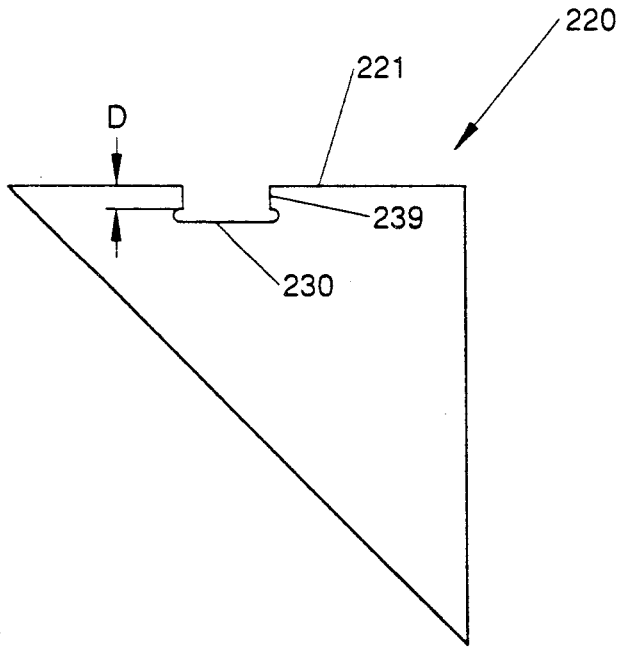
FIG. 5 is a sectional view of an alternative embodiment of the corner cap of the present invention.

An alternative embodiment of a cap of the present invention is shown in FIG. 5 wherein there is shown a sectional view of cap 220. Cap 220 includes plug 230 having under cut 239 extending around its perimeter such that the cross-sectional dimensions of plug 230 is smaller at a point near primary wall 221 than at the point furthest away from primary wall 221. This undercut 239 allows the cap 220 to snap fit into the plug receptacle 17. For this embodiment to function properly it is necessary to have apertures 45 and 46 of FIG. 3 sized correctly. Aperture 45 should have substantially the same dimensions as the cross-section of plug 230 at a location where the undercut is. Aperture 46 should have dimensions that are at least as large as the cross-section of plug 230 at a location below the undercut 239. If the plug receptacle is to also act as the dispensing orifice, as discussed above, aperture 44 should also be at least be as large as the cross-section of the plug 230 at a point below the undercut 239. The larger apertures 44 and 46 are the easier it is to align them when the top wall is constructed. The depth D of the under cut 239 should be approximately equal to the thickness of panel 43. Where the plug receptacle 17 is to also act as the dispensing orifice it is important that the D not be too large or else a poor seal is obtained between the plug 230 and the plug receptacle 17. If D is too small the plug 230 may not fit into receptacle 17.

Figure 6:
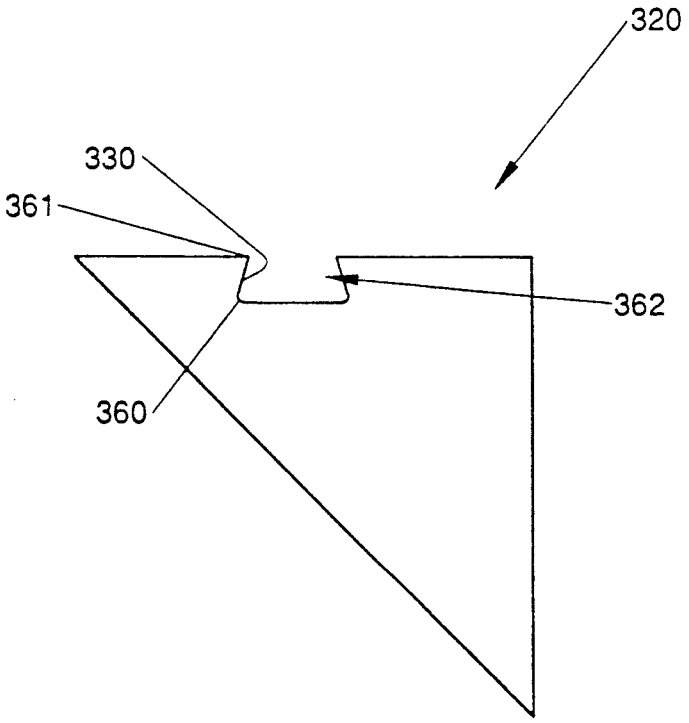
FIG. 6 is a sectional view of a particularly preferred embodiment of the corner cap of the present invention.

A particularly preferred embodiment of a corner cap of the present invention is shown in FIG. 6 where there is shown a sectional view of cap 320 having plug 330. As seen in FIG. 6 plug 330 is tapered from its bottom end 360 to its top 361. This embodiment of the cap securely retains the cap to the carton if the plug 330 and the plug receptacle 17 are sized properly. Aperture 46 should have dimensions at least as large as the cross section of plug 330 at its bottom 360. If the plug receptacle is to also be used as the dispensing orifice the dimensions of aperture 44 should at least be as large as the cross-section of plug 330 at its bottom 360. The plug should be so sized that at a point 362 where the cross-sectional dimensions of the plug 330 are equal to the dimensions of aperture 45, the vertical distance from point 362 to the top 361 of plug 330 is approximately equal to the thickness of panel 42. This ensures a snug fit of cap 320 to carton 10. If the distance is too large a poor seal is created between plug 330 and plug receptacle 17.

Figure 7B:
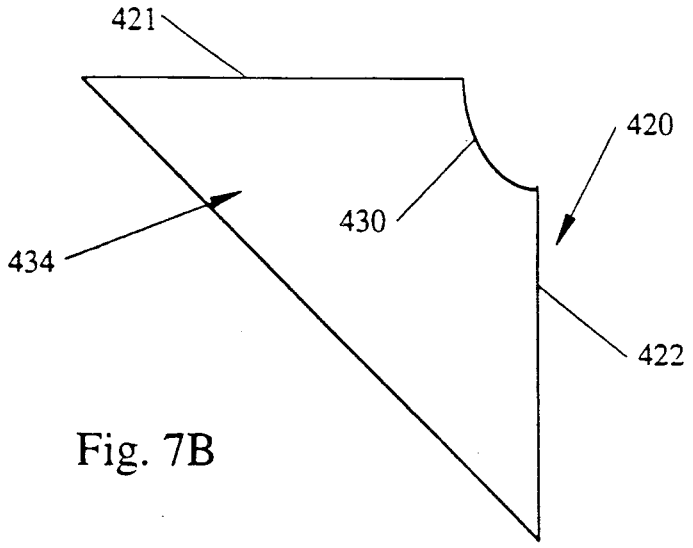
FIG. 7B is a sectional view of a cap for the carton of FIG. 7A.
Figure 7A:
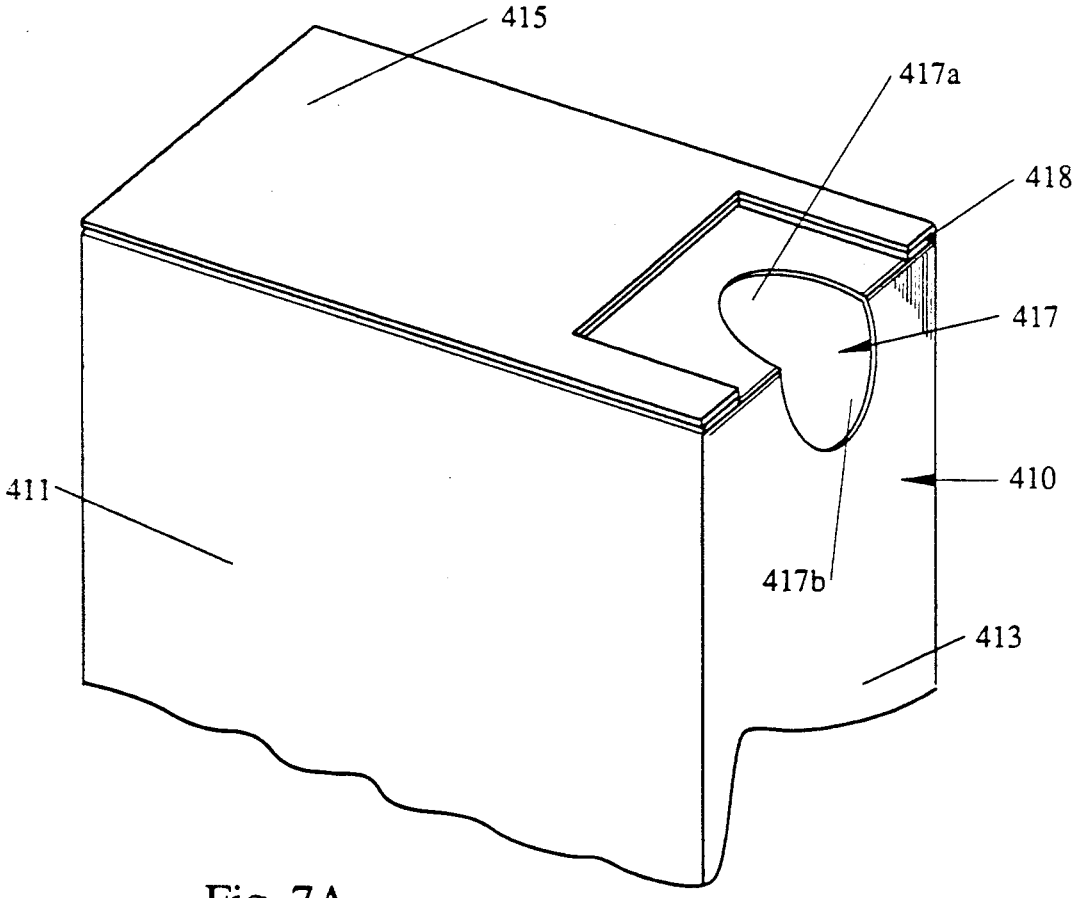
FIG. 7A is a perspective view of the top portion of an alternative embodiment of a carton of the present invention.

FIGS. 7A and 7B show yet another alternative embodiment of the present invention. FIG. 7A is a sectional view of the cap 420 of this embodiment and FIG. 7B is a perspective view of the top portion of the carton 410 of this embodiment. Carton 410 has plug receptacle 417 that comprises two halves **417*a* and 417*b* meeting along top edge 418. Plug receptacle 417 also acts as the dispensing orifice. Half 417*a* is located on top wall 415 adjacent top edge 418 and half 417*b* is located on side wall 413 adjacent top edge 418. Cap 420 has plug 430 that extends into inner container space 434. Plug 430 extends from both primary wall 421 and primary wall 422 and is rounded off so that it will telescope into receptacle 417** in a complementary fashion.

Figure 7C:
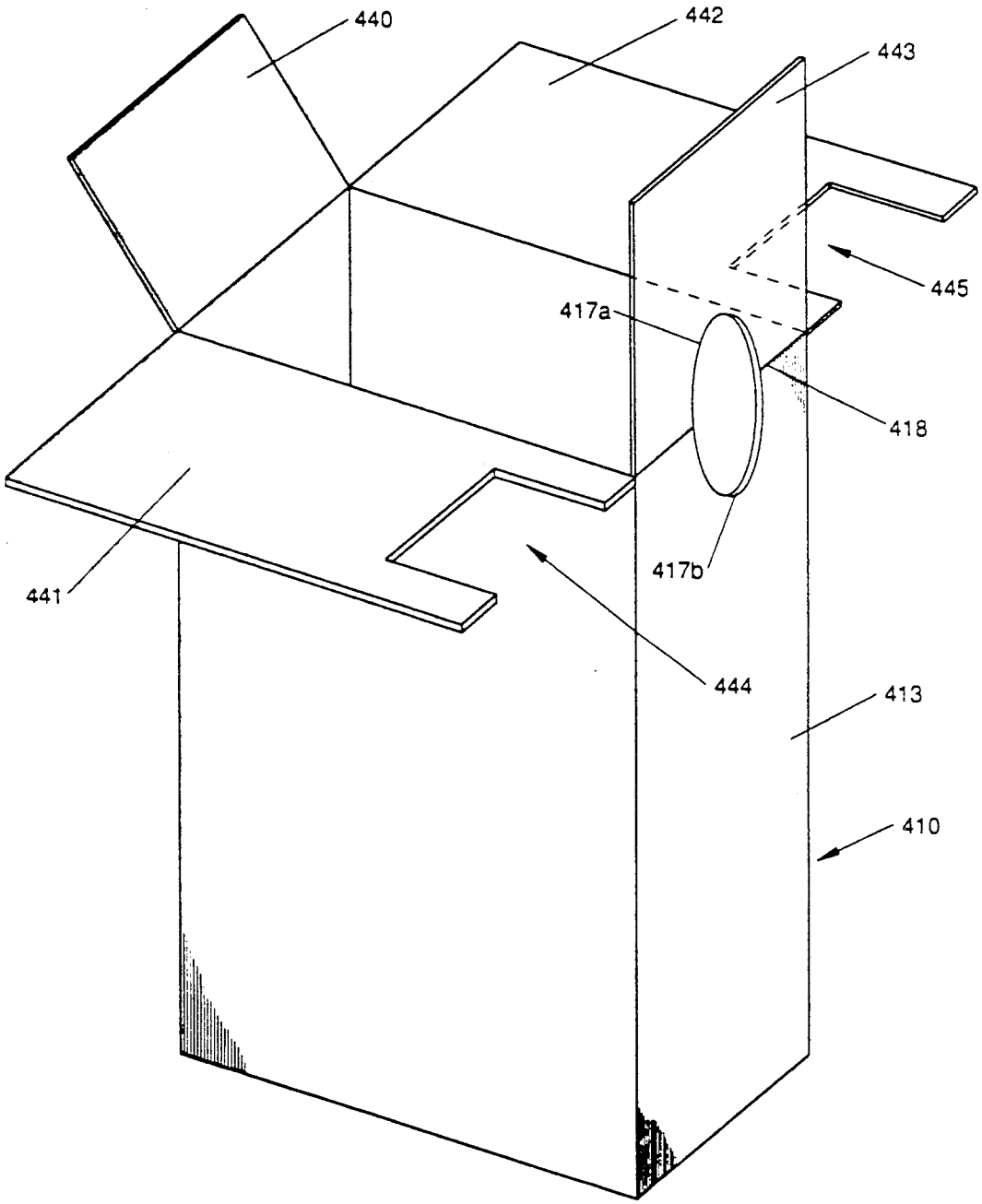
FIG. 7C is a perspective view of an alternative embodiment of the carton of the present invention wherein the top wall is disassembled.

FIG. 7C is a drawing similar to FIG. 3 but showing how one could construct the top wall 415 of carton 410. Top wall 415 of Carton 410 comprises two major flaps 441 and 442 and two minor flaps 440 and 443. As discussed earlier in connection with carton 10, when top wall 415 is constructed in order to obtain the best seal, a major flap such as 442 is folded first then the two minor flaps 440 and 443 and lastly major flap 441 is folded. A suitable adhesive is placed between the overlapping flaps to secure the top wall 415.

To facilitate the embodiment of carton 410 major panels 441 and 442 have cut out sections 444 and 445. These cut out sections are needed so that major flaps 441 and 442 do not cover up plug receptacle half **417*a*. Plug receptacle 417 comprises plug receptacle half 417*a* cut out of minor panel 443 and plug receptacle half 417*b* cut out of side wall 413 of carton 410. Either half 417*a* or 417*b* could be eliminated thereby resulting in a smaller plug receptacle 417 and hence a smaller dispensing orifice. The design of cap 420** would have to be changed to accommodate for this.

The embodiment of carton 410 substantially reduces the problem of granular material becoming trapped between the plug receptacle/dispensing orifice 417 and top edge 418 during pouring.

Tape may be used to help secure the cap 20 to package 10 prior to first use by the consumer. The tape could be secured to one or more of the primary walls 21 and 22 or the secondary walls 23 and 24 of cap 20 and to one or more of the top wall 15, side wall 13, front wall 11 or back wall 12 of the carton 10. The tape would be placed on the package when the cap 20 is on carton 10 as shown in FIG. 1. When the consumer is ready to use the package the tape is removed and then discarded. The consumer would grip cap 20 by the secondary side walls 23 and 24 and remove the cap from the carton by pulling it off. The consumer would pour the granular material from the carton into the cap until the material reaches the fill line 35 or until the cap is full. The material is then poured from the cap 20 into a dishwasher or the like. The cap is the placed back on the carton 10 with the common edge 25 of cap 20 overlaying the top edge 18 of carton 10 and with plug 30 telescoping into the plug receptacle 17 in a complementary fashion.

While particular embodiments of the present invention have been illustrated and described, various modifications will be apparent to those skilled in the art without departing from the spirit and scope of the present invention. For instance the plug receptacle 17 of carton 10 could be placed on the side wall 13 adjacent top edge 18 in stead of on the top wall 15. Accordingly, the scope of the present invention should be considered in terms of the following claims and is understood not to be limited to the details described and shown in the specification and drawings.

What is claimed is:

1. A package for storing and dispensing a granular material or product, said package comprising;

(a) a generally rectangular carton for storing said granular material, said carton comprising, opposing front and back walls, opposing side walls and opposing top and bottom walls, said carton further including a plug receptacle formed in at least one place in at least one of said top and side walls at a location adjacent a top edge of the carton which extends between the front and back walls; and (b) a removable cap for measuring a pre-determined quantity of said material, said cap comprising two primary walls having substantially the same width as said top edge of said carton and joined together along a common edge at a substantially right angle, and two secondary walls opposing each other and connected to said primary walls along their side edges such that said cap forms a cup type container having an inner container space;

(c) at least one of said primary walls having a plug extending into said container space, said plug being so located, sized and shaped that it will telescope in complementary fashion into said plug receptacle when said cap is applied to the carton with said common edge of said cap overlaying said top edge of said carton; and (d) a means to dispense said granular material from said carton to said inner container space of said cap.

2. The package of claim 1 wherein said carton has a single plug receptacle on said top wall of said carton adjacent said top edge.

3. The package of claims 1 or 2 wherein said plug receptacle is an orifice that projects through the entire thickness of said top wall such that said plug receptacle is also a dispensing orifice that is the means used to dispense said material from said carton to said cap.

4. The package of claim 2 wherein said plug receptacle is an orifice that projects through the entire thickness of said top wall such that said plug receptacle is also a dispensing orifice that is the means used to dispense said material from said carton to said cap, said plug receptacle being in the shape of a trapezoid having bases substantially parallel to said top edge wherein said larger base is further away from said top edge than said smaller base.

5. The package of claim 2 wherein said means used to dispense said granular material from said carton to said inner container space of said cap is a dispensing orifice located on said side wall of said carton at a point adjacent said top edge.

6. The package of claim 5 wherein said dispensing orifice includes a pouring spout, said pouring spout having an open position to dispense said granular material and a closed position to seal said orifice.

7. The package of claim 1 wherein said plug has a smaller cross-section near said primary wall that said plug extends from and a larger cross-section further away from said same primary wall.

8. The package of claim 6 wherein said plug includes an undercut around its perimeter adjacent said primary wall.

9. The package of claim 1 wherein said cap further includes a fill line to denote the quantity of said granular material that should be dispensed into said cap.

10. The package of claim 1 wherein said carton is comprised of paperboard.

11. A package for storing and dispensing granular materials, said package comprising:

(a) a generally rectangular paperboard carton for storing said granular material, said carton comprising, opposing front and back walls, opposing side walls and opposing top and bottom walls, said carton further including a plug receptacle formed in the top wall at a location adjacent a top edge of the carton which extends between the front and back walls; and (b) a removable cap for measuring a pre-determined quantity of said material, said cap comprising two primary walls having substantially the same width as said top edge of said carton and joined together along a common edge at a substantially right angle, and two secondary walls opposing each other and connected to said primary walls along their side edges such that said cap forms a cup type container having an inner container space;

(c) a plug extending from one of said primary walls into said container space, said plug being so located, sized and shaped so as to telescope in complementary fashion into said plug receptacle when said cap is applied to the carton with said common edge of said cap overlaying said top edge of said carton; and (d) a dispensing orifice located on said side wall of said carton at a point adjacent said top edge having a pouring spout, said pouring spout having an open position to dispense said granular material and a closed position to seal said orifice.

* * * * *